US006076749A

United States Patent [19]

Moore et al.

[11] Patent Number: 6,076,749

[45] Date of Patent: Jun. 20, 2000

[54] WATER SUPPLY APPARATUS FOR ICE MAKING MACHINE

[75] Inventors: Michael Moore, Louisville, Ky.; Craig C. Lear; Kazuhiro Yoshida, both of Peachtree City, Ga.

[73] Assignee: Hoshizaki America, Inc., Peachtree City, Ga.

[21] Appl. No.: 09/264,868

[22] Filed: Mar. 9, 1999

[51] Int. Cl.[7] ..... B05B 1/14

[52] U.S. Cl. ..... 239/556; 239/565

[58] Field of Search ..... 239/556, 565, 239/557, 566; 62/74, 347

[56] References Cited

U.S. PATENT DOCUMENTS

| | | | |
|---|---|---|---|
| 444,564 | 1/1891 | Copeland . | |
| 1,507,909 | 9/1924 | Davis . | |
| 2,746,799 | 5/1956 | Nelson . | |
| 3,419,251 | 12/1968 | Eckert . | |
| 4,657,188 | 4/1987 | Crane et al. | 239/557 |

*Primary Examiner*—Andres Kashnikow
*Assistant Examiner*—Christopher S. Kim
*Attorney, Agent, or Firm*—Arent Fox Kintner Plotkin & Kahn, PLLC

[57] ABSTRACT

A water spraying apparatus for an ice making machine including an icing water sprayer having three spray tubes, a lateral header portion joining one end of each of the spray tubes together, and a pair of spray tube inlets connected to the lateral header portion. The spray tubes are spaced apart from and extend in parallel to each other. The bottom wall of each of the tubes has a plurality of water spray holes formed therein. The icing water sprayer is an integral one-piece structure. The spray tube inlets are symmetrically provided with respect to the longitudinal axis of the sprayer and have water supply connection openings with central axes in parallel with the lateral axis and facing each other. The spray tube inlets are preferably formed as a tee joint having a stem joined to the first wall of the lateral header portion and two arms with one arm having the water supply connection opening and the other arm being closed.

12 Claims, 5 Drawing Sheets

WATER SUPPLY APPARATUS FOR ICE MAKING MACHINE

BACKGROUND OF THE INVENTION

The present invention relates to a water spraying apparatus for an ice making machine and, more particularly, to an apparatus for supplying water for making ice in a flow-down type ice making machine that provides uniform flow to each spray tube.

Flow type ice making machines are well known for automatic making of ice. The ice is made by supplying ice making water to flow down over the surfaces of ice making plates which are cooled by the heat of evaporation of a coolant. Generally, pairs of ice making plates are vertically disposed in a back to back opposite relation. A refrigerating pipe containing the coolant is sandwiched between the rear surfaces of each of the pair of ice making plates. Water is sprayed or sprinkled from a water spray apparatus disposed above the ice making plates and flows downwardly along the front or exposed surfaces of the pair of ice making plates. As the water flows down over the plates, ice is formed. In the ice extracting operation which follows the ice making operation, a hot gas is forced to flow through the refrigerating plate to heat the ice making plates for melting the ice formed on the surfaces. Additionally, deicing water for promoting melting and separation or detachment of the ice from the plates is generally caused to flow between the rear surfaces of the pair of ice making plates.

Generally, such ice making machines house several pairs of ice making plates and, in particular, one such commercially available ice making machine has six pairs of such plates provided in the machine in two sets of three pairs.

Generally, the water supply apparatus constitutes a part of a water supply loop for circulating the water from and to a water collector tank disposed below the ice making plates. The water supply apparatus includes a water spray device which serves to spray a relatively large amount of water on the front surfaces of the pair of ice making plates. Such apparatuses are shown in U.S. Pat. Nos. 4,526,014, 4,580,410, 4,601,178, 4,791,792, 5,237,837, 5,493,872 and 5,520,011. The last two mentioned patents are particularly directed to a water sprinkling or water spray tube structure.

Various spray tube designs have given varied results for multi-plate evaporators. Due to depleted water flow to certain sections of the evaporator, the ice making machine can produce unsuitable product such as ice with irregular shapes, cloudy ice, immature ice, and a variety of other problems. It has been difficult to provide uniform water flow to all of the portions of all of the multiple pairs of ice making plates.

Another important consideration in the design of a water supply apparatus in addition to the provision of more even distribution of water flow to the ice making plates, is the ever present consideration of cost in manufacturing of the apparatus as well as the indirect cost of labor in manufacturing and/or repairing of the overall ice making machine.

OBJECTS AND SUMMARY OF THE INVENTION

It is an object of the present invention to provide a water spraying apparatus for an ice making machine which more evenly and uniformly delivers water to the multiple pairs of ice making plates.

It is another object of the present invention to provide a water spraying apparatus which can be manufactured as an integral, one-piece structure.

It is yet a further object of the present invention to provide a water spraying apparatus which is economical to manufacture and simple to retro-fit into existing ice making machines.

Accordingly, the present invention is a water spraying apparatus for an ice making machine, comprising an icing water sprayer having three spray tubes, a lateral header portion joining one end of each of the three spray tubes together, the tubes being spaced apart from and extending in parallel to each other, each of the tubes having a bottom wall, each bottom wall having formed therein and distributed thereover a respective plurality of water spray holes, and a pair of spray tube inlets connected to the lateral header portion on a first wall opposite to a second wall where the three tubes are joined, the icing water sprayer being an integral, one piece structure.

The invention further resides in a water spraying apparatus as above, wherein the sprayer has a longitudinal axis, the lateral header portion has an axis, and the spray tube inlets are symmetrically provided with respect to the longitudinal axis and have water supply connection openings having central axes in parallel with the lateral axis.

The water supply connection openings can face each other.

Preferably, the spray tube inlets are formed as a tee joint having a stem joined to the first wall of the lateral header portion and two arms with one arm having the water supply connection opening and the other arm being closed.

The integral one-piece structure of the icing water sprayer can result from formation thereof by a blow-molding operation. Each the water spray hole can result from formation thereof simultaneously with molding of the icing water sprayer.

The water spraying apparatus of the present invention can further comprise a spray tube hose, the hose including an integral lateral tee having a stem and a pair of arms, a diagonally extending portion joining the stem at an acute angle thereto, and an inlet end portion joining the diagonally extending portion at an end opposite to the lateral tee and extending in parallel with an axis of the stem, the pair of arms of the lateral tee being connected to the pair of spray tube inlets, and means connected to the inlet end portion for supplying water to the icing water sprayer.

The means connected to the inlet end portion for supplying water to the icing water sprayer can include a water pump connected to a supply of water, and a Y-tube distributor connected to the water pump and to the inlet end portion, the Y-tube distributor having a smooth flow path interior minimizing back pressure and evenly distributing water flow therethrough.

Overall, the water spraying apparatus for an ice making machine of the present invention comprises an icing water sprayer having a longitudinal axis and three spray tubes, a lateral header portion joining one end of each of the three spray tubes together and having an axis, the tubes being spaced apart from and extending in parallel to each other, each of the tubes having a bottom wall, each the bottom wall having formed therein and distributed thereover a respective plurality of water spray holes, and a pair of spray tube inlets connected to the lateral header portion on a first wall opposite to a second wall where the three tubes are joined, the icing water sprayer being an integral, one piece structure, the spray tube inlets being symmetrically provided with respect to the longitudinal axis and having water supply connection openings having central axes in parallel with the lateral axis, the water supply connection openings facing each other, the spray tube inlets being formed as a tee joint having a stem joined to the first wall of the lateral header portion and two arms, one arm having the water supply connection opening and the other arm being closed; a spray tube hose, the hose including an integral lateral tee having a stem and a pair of arms, a diagonally extending portion joining the stem at an acute angle thereto, and an inlet end portion joining the diagonally extending portion at an end opposite to the lateral tee and extending in parallel with an axis of the stem, the pair of arms of the lateral tee being connected to the pair of spray tube inlets; and means connected to the inlet end portion for supplying water to the icing water sprayer.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
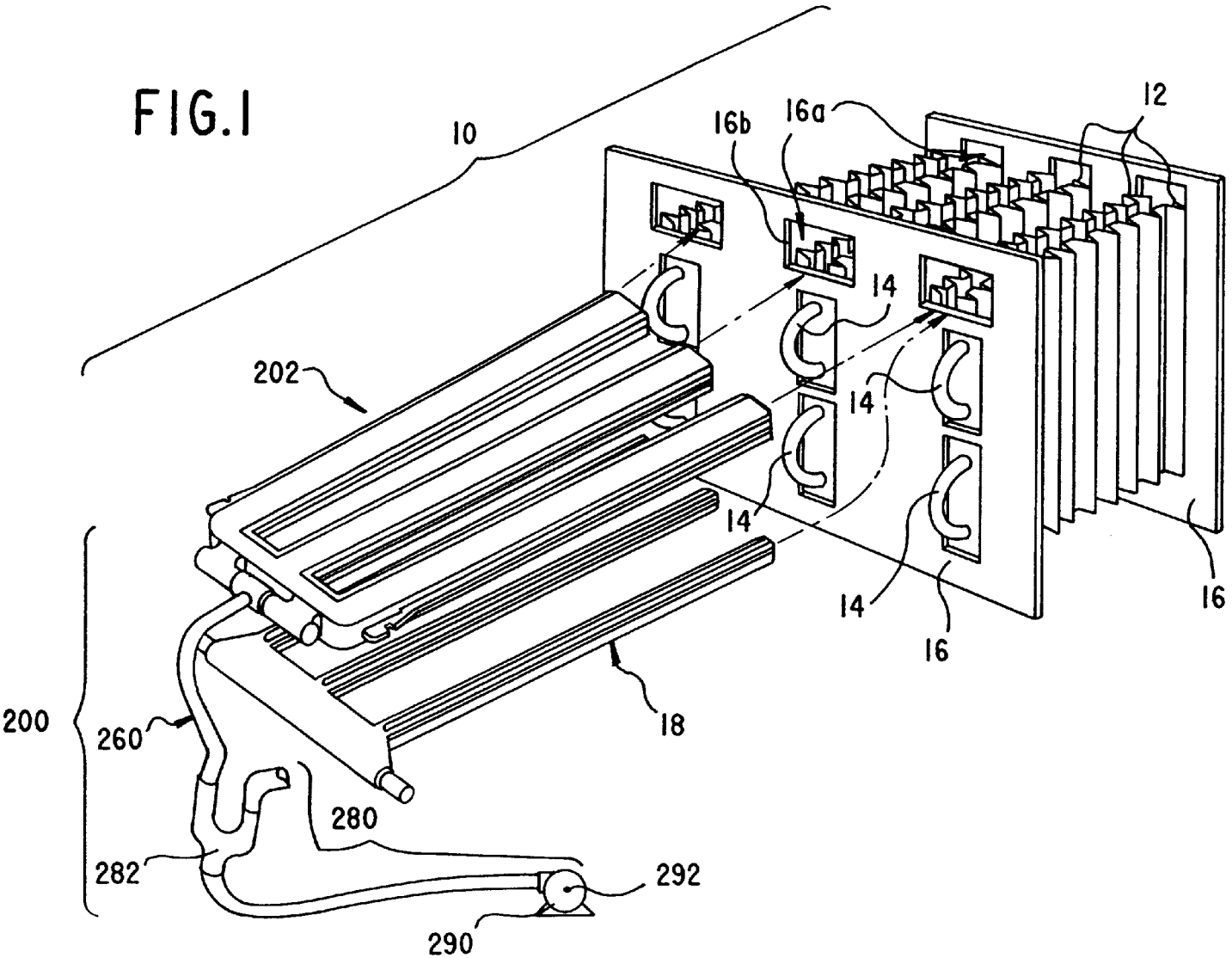
FIG. 1 is a perspective exploded view of the water spraying apparatus of the present invention in conjunction with a portion of an ice making machine.

The present invention is a water spraying apparatus 200 for an ice making machine 10 which is shown in a general view in FIG. 1. The ice making machine 10 itself includes pairs of ice making plates 12 positioned back to back with an evaporator tube 14 running therebetween. A frame 16 holds the pairs of plates 12 in position. Each evaporator tube 14 is connected to a conventional refrigerating circuit and further description thereof is not required herein.

The water spraying apparatus 200 of the present invention includes the icing water sprayer 202, the supply hose 260 connected thereto, and a means 280 for supplying water. The means 280 for supplying water can include a Y-tube distributor 282. Commonly, in conventional ice making machines, two sets of three evaporators are provided. The Y-tube distributor 282 enables connection to both otherwise identical sets with mirror-image, but otherwise identical icing water sprayers 202. Each ice making machine 10 is also provided with de-icing water sprayers 18. The de-icing water sprayers 18 are provided to flow water over the back surfaces of the ice making plates 12 to release and separate the ice from the surfaces of the plates 12 in an ice extracting operation.

Figure 2:
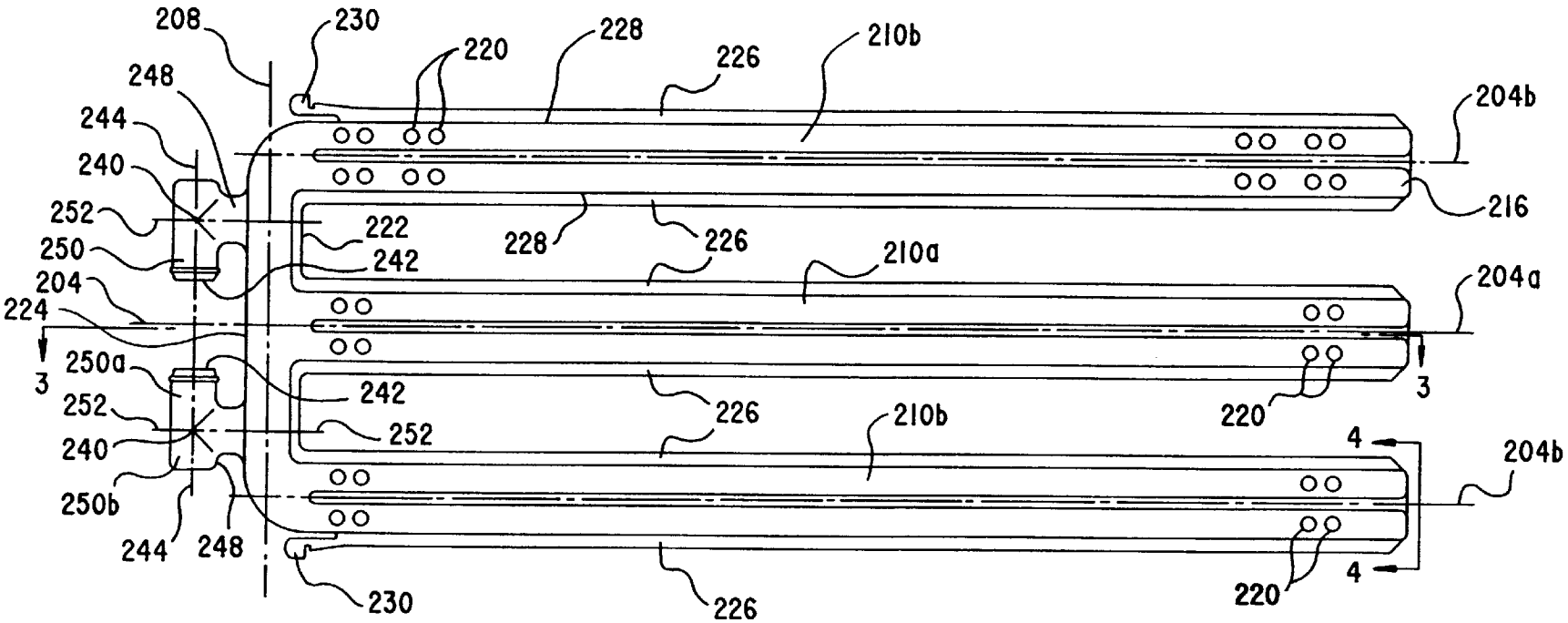
FIG. 2 is a bottom plan view of the icing water sprayer of the present invention.
Figure 4:
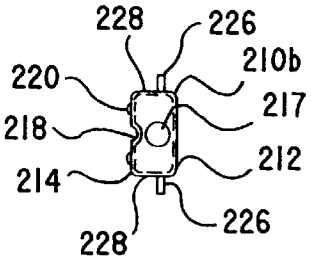
FIG. 4 is a cross-sectional view taken along line 4—4 of FIG. 2.
Figure 3:
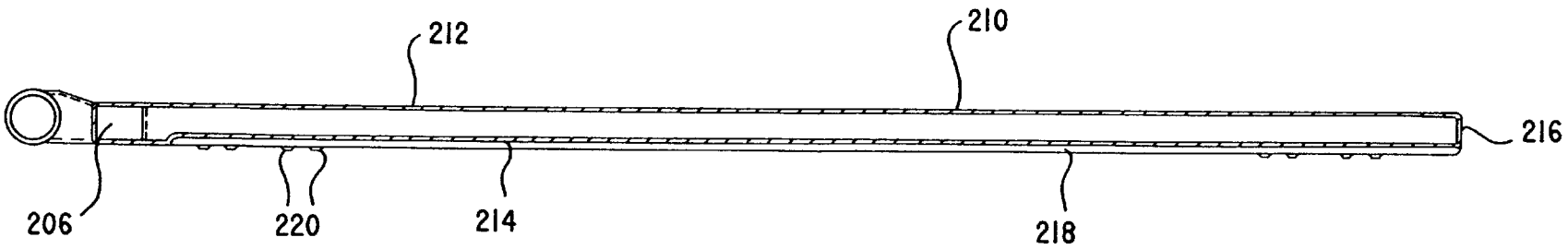
FIG. 3 is a cross-sectional view taken along line 3—3 of FIG. 2.
Figure 5:
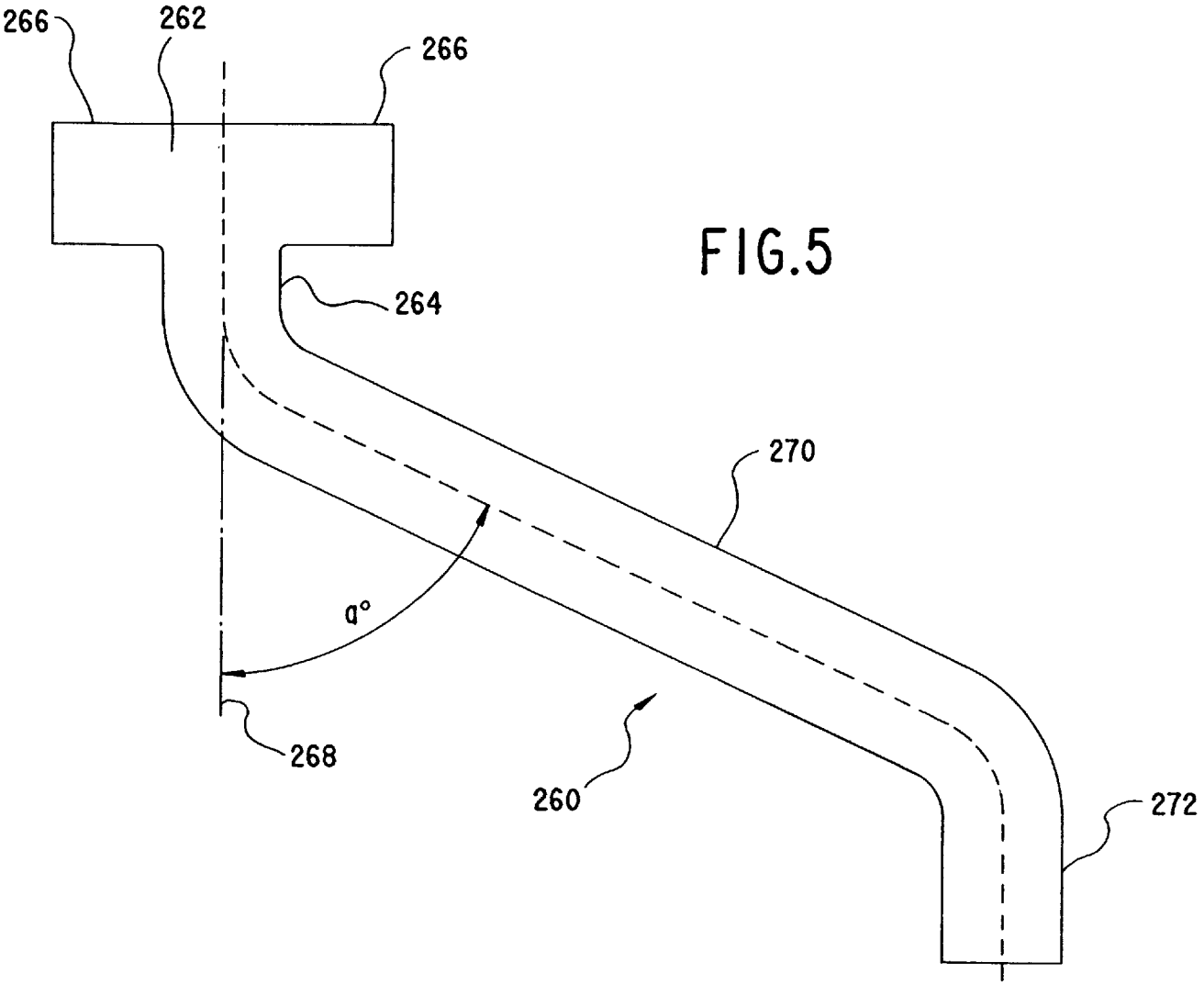
FIG. 5 is a sectional view of the spray tube hose of the present invention.
Figure 7:
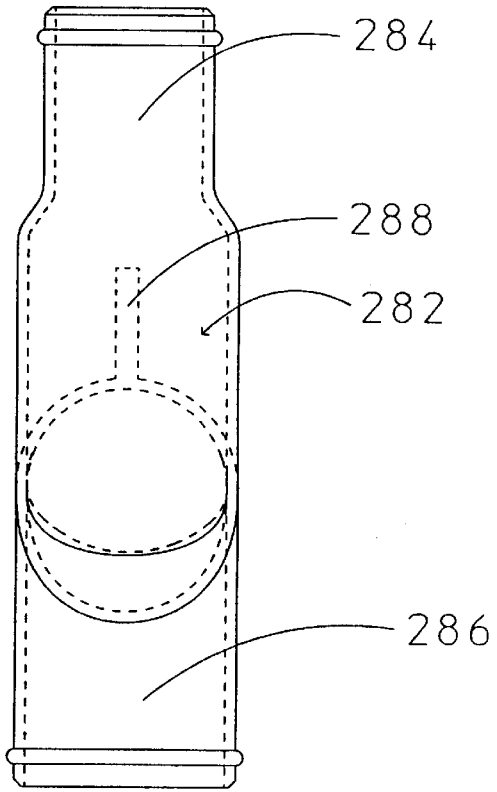
FIG. 7 is a cross-sectional view taken along line 7—7 in FIG. 6.
Figure 6:
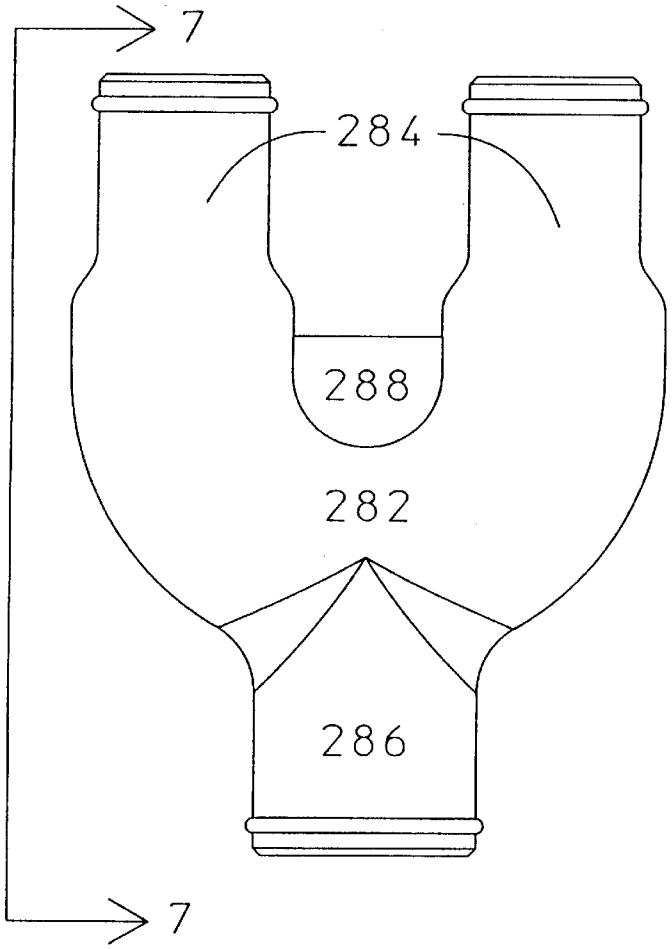
FIG. 6 is a plan view of the Y-tube distributor of the present invention.

The icing water sprayer 202 of the present invention has three spray tubes 210 including a central tube 210*a* and two outer tubes 210*b*. In many respects, these tubes 210 are substantially identical. Each spray tube 210 is joined at one end thereof to a lateral header portion 206. The tubes 210 are spaced apart from each other and extend in parallel to each other. Each of the tubes 210 has a top wall 212, a bottom wall 214, and an end wall 216. The bottom wall 214 is provided with a plurality of water spray holes 220. As shown in FIG. 2, the holes 220 can be provided in pairs. Further, the bottom wall 214 can be provided with a longitudinally extending groove 218. This groove 218 is designed for seating of a corresponding shaped portion of a de-icing water sprayer 18 such as the one shown in U.S. Pat. No. 4,493,872 or the one shown in U.S. Pat. No. 5,520,011 (both patents being hereby expressly incorporated herein by reference). Each of the tubes 210 has a cleaning hole 217 in the end wall 216 which is generally plugged in a conventional manner.

The lateral header portion 206 has a second wall 222 where the three tubes join together and a first wall 224 in which a pair of spray tube inlets 240 are connected. The first wall 224 is opposite to the second wall 222 where the three tubes are joined.

The icing water sprayer 202 is made as an integral, one-piece structure. This one-piece structure can result from a blow molding operation. During the blow molding operation, the water spray holes 220 can be formed simultaneously with the molding of the sprayer itself. Also formed during the molding, are extension fins 226 extending along both lateral sides 228 of each of the tubes. At the lateral header portion 206 end on the outer lateral fin 226 of the respective outer tubes 210*b*, are formed stoppers 230. These stoppers 230 engage with the frames 16 of the ice making machines at the lateral edges 16*b* of the openings 16*a* in the frames through which the water spray tubes 210 are inserted. This anchors the icing water sprayer 202 in the frame 16 of the ice making machine 10 and ensures the proper positioning thereof. The fins 226 extending from the lateral sides 218 of the ice making sprayer tubes 210 reinforce and strengthen the tubes 210.

As can be seen in FIG. 2, the spray tube inlets 240 are symmetrically provided with respect to the longitudinal axis 204 of the overall sprayer 202. Each of the spray inlet tubes 240 has a water supply connection opening 242 with a central axis 244 in parallel with a lateral axis 208 of the lateral header portion 206. The connection openings 242 of the two spray tube inlets 240 face each other. Further, the spray tube inlets 240 are formed as a tee joint 246 having a stem 248 joined to the wall of the lateral header portion 206 and two arms 250. One of the arms 250*a* opens to the water supply connection opening 242 and the other arm 250*b* is closed. The spray tube inlets 240 while being symmetrically positioned with respect to a longitudinal axis 204 of the water sprayer 202 are positioned to optimize the uniformity of flow of water through each of the individual spray tubes 210. To this end, the distance from the longitudinal axis 204 of the water sprayer 202 to the inlet axis 252 of the spray tube inlet 240 is designed to be offset further towards the outer spray tube 210*b* than centered with respect to the central spray tube 210*a* and outer spray tubes 210*b*. That is, rather than have the inlet axis 252 equidistantly positioned between the longitudinal axis 204*a* of the center spray tube and the longitudinal axis 204*b* of the outer spray tube, the inlet axis 252 is offset closer to the longitudinal axis 204*b* of the outer spray tube 210*b*. Preferably, the inlet axis 252 is positioned at a point from ⅝ to ⅞ of the distance between the longitudinal axis 204*a* of the center spray tube 210*a* and the longitudinal axis 204*b* of the outer spray tube 210*b*.

The water spraying apparatus 200 preferably further includes a supply hose 260 optimally designed for uniform, non-turbulent water flow between a means for supplying water and the spray tube inlets 240. This supply hose 260 includes an integral lateral tee 262 having a stem 264 and a pair of arms 266, the stem having a stem axis 268. The pair of arms 266 are connected directly to the connection openings 242 of the spray tube inlets 240. The hose 260 further includes a diagonally extending portion 270 joining the stem 264 at an acute angle a thereto and an inlet end portion 272 joining the diagonally extending portion 270 at an end opposite to the lateral tee 262. The inlet end portion 272 extends in parallel with the axis 268 of the stem 264. The means for supplying water connects to the inlet end portion 272.

To further ensure non-turbulent and smooth uniform water flow to the spray tube inlets, the invention contemplates a Y-tube distributor 282 connected at one end to a water pump 290 (connected to a source of water 292) and at the other end to the inlet end portion 272 of the supply hose 260. The Y-tube distributor 282 has a smooth flow path interior minimizing back pressure and evenly distributing water flow therethrough from the central inlet 286 to both of the outlet arms 284. A lateral reinforcement member 288 is provided between the outlet arms 284. This lateral reinforcement member 288 keeps the outlet arms 284 from flexing and keeps the distributor from twisting. The Y-tube distributor 282 is also provided to enable symmetrically arranged, mirror-image water spray apparatuses 200 to be provided in a conventional, commercial ice making machine 10.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What we claim is:

1. A water spraying apparatus for an ice making machine, comprising: an icing water sprayer having three spray tubes, a lateral header portion joining one end of each of said three spray tubes together, said tubes being spaced apart from and extending in parallel to each other, each of said tubes having a bottom wall, each said bottom wall having formed therein and distributed thereover a respective plurality of water spray holes, and a pair of spray tube inlets connected to said lateral header portion on a first wall opposite to a second wall where said three tubes are joined, said icing water sprayer being an integral, one piece structure.

2. A water spraying apparatus as in claim 1, wherein said sprayer has a longitudinal axis, said lateral header portion has an axis, and said spray tube inlets are symmetrically provided with respect to said longitudinal axis and have water supply connection openings having central axes in parallel with said lateral axis.

3. A water spraying apparatus as in claim 1, wherein said water supply connection openings face each other.

4. A water spraying apparatus as in claim 2, wherein said spray tube inlets are formed as a tee joint having a stem joined to said first wall of said lateral header portion and two arms, one arm having said water supply connection opening and the other arm being closed.

5. A water spraying apparatus as in claim 3, wherein said spray tube inlets are formed as a tee joint having a stem joined to said first wall of said lateral header portion and two arms, one arm having said water supply connection opening and the other arm being closed.

6. A water spraying apparatus as in claim 1, wherein said integral onepiece structure of said icing water sprayer results from formation thereof by a blow-molding operation.

7. A water spraying apparatus as in claim 6, wherein each said water spray hole results from formation thereof simultaneously with molding of said icing water sprayer.

8. A water spraying apparatus as in claim 1, further comprising a supply hose, said hose including an integral lateral tee having a stem and a pair of arms, a diagonally extending portion joining the stem at an acute angle thereto, and an inlet end portion joining said diagonally extending portion at an end opposite to said lateral tee and extending in parallel with an axis of the stem, said pair of arms of said lateral tee being connected to said pair of spray tube inlets, and means connected to said inlet end portion for supplying water to said icing water sprayer.

9. A water spraying apparatus as in claim 8, wherein means connected to said inlet end portion for supplying water to said icing water sprayer includes a water pump, and a Y-tube distributor connected to said water pump and to said inlet end portion, said Y-tube distributor having a smooth flow path interior minimizing back pressure and evenly distributing water flow therethrough, a central inlet, a pair of outlet arms, and a lateral reinforcement member between said outlet arms.

10. A water spraying apparatus for an ice making machine, comprising: an icing water sprayer having a longitudinal axis and three spray tubes, a lateral header portion joining one end of each of said three spray tubes together and having an axis, said tubes being spaced apart from and extending in parallel to each other, each of said tubes having a bottom wall, each said bottom wall having formed therein and distributed thereover a respective plurality of water spray holes, and a pair of spray tube inlets connected to said lateral header portion on a first wall opposite to a second wall where said three tubes are joined, said icing water sprayer being an integral, one piece structure, said spray tube inlets being symmetrically provided with respect to said longitudinal axis and having water supply connection openings having central axes in parallel with said lateral axis, said water supply connection openings facing each other, said spray tube inlets being formed as a tee joint having a stem joined to said first wall of said lateral header portion and two arms, one arm having said water supply connection opening and the other arm being closed;

a supply hose, said hose including an integral lateral tee having a stem and a pair of arms, a diagonally extending portion joining the stem at an acute angle thereto, and an inlet end portion joining said diagonally extending portion at an end opposite to said lateral tee and extending in parallel with an axis of the stem, said pair of arms of said lateral tee being connected to said pair of spray tube inlets; and means connected to said inlet end portion for supplying water to said icing water sprayer.

11. A water spraying apparatus for an ice making machine, comprising:

a pair of icing water sprayers, each icing water sprayer having a longitudinal axis and three spray tubes, a lateral header portion joining one end of each of said three spray tubes together and having an axis, said tubes being spaced apart from and extending in parallel to each other, each of said tubes having a bottom wall, each said bottom wall having formed therein and distributed thereover a respective plurality of water spray holes, and a pair of spray tube inlets connected to said lateral header portion on a first wall opposite to a second wall where said three tubes are joined, said icing water sprayer being an integral, one piece structure, said spray tube inlets being symmetrically provided with respect to said longitudinal axis and having water supply connection openings having central axes in parallel with said lateral axis, said water supply connection openings facing each other, said spray tube inlets being formed as a tee joint having a stem joined to said first wall of said lateral header portion and two arms, one arm having said water supply connection opening and the other arm being closed;

a pair of supply hoses, each said hose including an integral lateral tee having a stem and a pair of arms, a diagonally extending portion joining the stem at an acute angle thereto, and an inlet end portion joining said diagonally extending portion at an end opposite to said lateral tee and extending in parallel with an axis of the stem, said pair of arms of said lateral tee of each supply hose being connected to said pair of spray tube inlets of one of said icing water sprayers; and means connected to said inlet end portion of each of said supply hoses for supplying water to said pair of said icing water sprayers.

12. A water spraying apparatus as in claim 11, wherein means connected to said inlet end portion of each of said supply hoses for supplying water to said pair of said icing water sprayers includes a water pump, and a Y-tube distributor connected to said water pump and to said inlet end portions of said supply hoses, said Y-tube distributor having a smooth flow path interior minimizing back pressure and evenly distributing water flow therethrough, a central inlet, a pair of outlet arms, and a lateral reinforcement member between said outlet arms, said inlet end portions being connected to respective ones of said outlet arms and said central inlet being connected to said water pump.

* * * * *